US011837186B2

(12) United States Patent
Hokazono et al.

(10) Patent No.: US 11,837,186 B2
(45) Date of Patent: Dec. 5, 2023

(54) LIQUID CRYSTAL PROJECTOR

(71) Applicant: SEIKO EPSON CORPORATION, Tokyo (JP)

(72) Inventors: Daigo Hokazono, Suwa (JP); Toru Aoki, Shiojiri (JP); Kazuhisa Mizusako, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/726,188

(22) Filed: Apr. 21, 2022

(65) Prior Publication Data

US 2022/0343869 A1 Oct. 27, 2022

(30) Foreign Application Priority Data

Apr. 22, 2021 (JP) ..... 2021-072400

(51) Int. Cl.

*G09G 3/36* (2006.01)
*G09G 3/00* (2006.01)
*G09G 3/20* (2006.01)

(52) U.S. Cl.

CPC ..... *G09G 3/36* (2013.01); *G09G 3/002* (2013.01); *G09G 3/2003* (2013.01); *G09G 3/2007* (2013.01); *G09G 3/3648* (2013.01); *G09G 2320/0252* (2013.01); *G09G 2320/0257* (2013.01); *G09G 2320/0261* (2013.01); *G09G 2320/0285* (2013.01); *G09G 2320/0666* (2013.01)

(58) Field of Classification Search

CPC ..... G09G 3/36; G09G 3/3607; G09G 3/002; G09G 3/2007; G09G 2320/0242; G09G 2320/0666; G09G 5/06; G09G 3/3648; G09G 2320/02; G09G 2320/0285; G09G 3/3696; G09G 2320/06; G09G 2320/066; G09G 2320/0252; G09G 2320/057; G09G 2320/0266; G09G 2320/0261; G09G 2320/0271

See application file for complete search history.

(56) References Cited

U.S. PATENT DOCUMENTS

| | | | | |
|---|---|---|---|---|
| 8,154,491 | B2 * | 4/2012 | Ho | G09G 3/3648 345/87 |
| 9,286,845 | B2 * | 3/2016 | Kimura | G09G 3/2003 |
| 9,554,106 | B2 * | 1/2017 | Sagawa | H04N 9/3105 |
| 11,322,104 | B2 * | 5/2022 | Chen | G09G 3/3648 |

(Continued)

FOREIGN PATENT DOCUMENTS

| | | |
|---|---|---|
| JP | 2004-004629 A | 1/2004 |
| JP | 2004-246312 A | 9/2004 |

(Continued)

*Primary Examiner* — Dismery Mercedes
(74) *Attorney, Agent, or Firm* — Oliff PLC

(57) ABSTRACT

When, in a liquid crystal projector, optical responsiveness of a liquid crystal panel corresponding to G is better than optical responsiveness of a liquid crystal panel corresponding to R, a display control circuit performs a tr correction and a tf correction of overdrive processing for R, and performs only the tr correction of the overdrive process for G, and does not perform the tf correction for G. The display control circuit performs a black floating process for R, G, and B.

5 Claims, 13 Drawing Sheets

(56) References Cited

U.S. PATENT DOCUMENTS

2003/0006949 A1* 1/2003 Sekiya ..... G09G 3/3648 345/87
2003/0179175 A1 9/2003 Shigeta et al.
2004/0125064 A1 7/2004 Adachi et al.
2005/0083353 A1* 4/2005 Maruyama ..... G09G 3/3611 345/690
2005/0162359 A1 7/2005 Sugino
2008/0284699 A1* 11/2008 Yano ..... G09G 3/3607 345/89
2009/0109247 A1* 4/2009 Kimura ..... G09G 3/3688 345/690
2011/0273489 A1* 11/2011 Inoue ..... G09G 3/3611 345/89
2013/0002618 A1* 1/2013 Furihata ..... G09G 3/3406 345/204
2013/0002620 A1* 1/2013 Du ..... G09G 3/003 345/204
2013/0057568 A1* 3/2013 Liao ..... G09G 3/3648 345/589
2013/0057791 A1* 3/2013 Kitayama ..... G09G 3/3614 349/37
2013/0162917 A1* 6/2013 Sagawa ..... H04N 9/3155 349/5
2013/0278645 A1* 10/2013 Liu ..... G09G 3/3607 345/690
2016/0366383 A1* 12/2016 Nishimori ..... H04N 9/3188
2021/0125571 A1 4/2021 Aoki et al.

FOREIGN PATENT DOCUMENTS

JP 2021-067786 A 4/2021
WO 03/098588 A1 11/2003

* cited by examiner

<PATTERN A>

R

| | | | | |
|---|---|---|---|---|
| COMPARATIVE EXAMPLE | 2.6V | 0.0V | 2.6V | 0.0V |
| EXEMPLARY EMBODIMENT | 2.6V | 0.0V | 2.6V | 0.0V |

G

| | | | | |
|---|---|---|---|---|
| COMPARATIVE EXAMPLE | 2.3V | 0.0V | 2.3V | 0.0V |
| EXEMPLARY EMBODIMENT | 2.2V | 1.0V | 2.2V | 1.0V |

B

| | | | | |
|---|---|---|---|---|
| COMPARATIVE EXAMPLE | 2.3V | 0.0V | 2.3V | 0.0V |
| REFERENCE EXAMPLE | 2.2V | 1.0V | 2.6V | 1.0V |

<PATTERN B>

R

| | | | | |
|---|---|---|---|---|
| COMPARATIVE EXAMPLE | 2.6V | 2.2V | 0.0V | 0.0V |
| EXEMPLARY EMBODIMENT | 2.6V | 2.2V | 0.0V | 1.0V |

G

| | | | | |
|---|---|---|---|---|
| COMPARATIVE EXAMPLE | 2.3V | 2.1V | 0.0V | 0.0V |
| EXEMPLARY EMBODIMENT | 2.2V | 2.1V | 1.0V | 1.0V |

B

| | | | | |
|---|---|---|---|---|
| COMPARATIVE EXAMPLE | 2.3V | 2.0V | 0.0V | 0.0V |
| REFERENCE EXAMPLE | 2.2V | 2.0V | 1.0V | 1.0V |

<PATTERN C>

R

| | | | | |
|---|---|---|---|---|
| COMPARATIVE EXAMPLE | 0.0V | 2.6V | 2.2V | 2.2V |
| EXEMPLARY EMBODIMENT | 0.0V | 2.6V | 2.2V | 2.2V |

G

| | | | | |
|---|---|---|---|---|
| COMPARATIVE EXAMPLE | 0.0V | 2.3V | 2.1V | 2.1V |
| EXEMPLARY EMBODIMENT | 1.0V | 2.2V | 2.1V | 2.1V |

B

| | | | | |
|---|---|---|---|---|
| COMPARATIVE EXAMPLE | 0.0V | 2.3V | 2.0V | 2.0V |
| REFERENCE EXAMPLE | 1.0V | 2.2V | 2.0V | 2.0V |

<PATTERN D>

R

| | | | | |
|---|---|---|---|---|
| COMPARATIVE EXAMPLE | 2.6V | 0.0V | 0.0V | 0.0V |
| EXEMPLARY EMBODIMENT | 2.6V | 0.0V | 1.0V | 1.0V |

G

| | | | | |
|---|---|---|---|---|
| COMPARATIVE EXAMPLE | 2.3V | 0.0V | 0.0V | 0.0V |
| EXEMPLARY EMBODIMENT | 2.2V | 1.0V | 1.0V | 1.0V |

B

| | | | | |
|---|---|---|---|---|
| COMPARATIVE EXAMPLE | 2.3V | 0.0V | 0.0V | 0.0V |
| REFERENCE EXAMPLE | 2.2V | 1.0V | 1.0V | 1.0V |

LIQUID CRYSTAL PROJECTOR

The present application is based on, and claims priority from JP Application Serial Number 2021-072400, filed Apr. 22, 2021, the disclosure of which is hereby incorporated by reference herein in its entirety.

BACKGROUND

1. Technical Field

The present disclosure relates to a liquid crystal projector.

2. Related Art

A liquid crystal projector is provided with a liquid crystal panel for each of three primary colors, for example, for each of red (R), green (G), and blue (B), primary color light is incident on the liquid crystal panel, and a modulated image is generated for each primary color. These modulated images are synthesized, and a synthesized image is expanded and projected onto a screen or the like. In the liquid crystal panel used in the liquid crystal projector, a blur occurs due to insufficient optical responsiveness to electrical changes.

In order to reduce this blur, a technique has been known for determining gray scale data supplied to a liquid crystal panel in accordance with a combination of before and after changes in the gray scale data (see WO 2003/098588 A1). Also, a technique has been known for determining a drive voltage supplied to a liquid crystal panel in accordance with a combination of input image signals before one vertical period processed in accordance with a predicted value of a transmittance of a pixel of a liquid crystal panel, and input image signals of a current vertical period (see JP 2004-246312 A). A technique has also been known for, when a LUT (look-up table) is used to determine gray scale data to be supplied to a liquid crystal panel based on before and after transition of the gray scale data, obtaining gray scale data serving as a target by interpolation calculation, in order to suppress capacity of the LUT (see JP 2004-4629 A).

However, in a liquid crystal projector, optical responsiveness of a liquid crystal panel may be different for each color. When the optical responsiveness of the liquid crystal panel is different for each color, and even when an achromatic color is to be displayed in a synthesized image, there is a problem that the transmittance in the liquid crystal panel is not the same, a chromatic color, rather than the achromatic color is visually recognized, that is, a colored image is visually recognized.

SUMMARY

In order to solve the problem described above, a liquid crystal projector according to an aspect of the present disclosure includes a display control circuit configured to process image data of a first color of image data specifying a gray scale level of a pixel to output the image data of the first color as a first data signal, and to process image data of a second color different from the first color of the image data to output the image data of the second color as a second data signal, a first liquid crystal panel including a first liquid crystal element to which a voltage is applied in accordance with the first data signal, the first liquid crystal element emitting incident light of the first color as first emission light at a ratio corresponding to an applied voltage, a second liquid crystal panel including a second liquid crystal element to which a voltage is applied in accordance with the second data signal, the second liquid crystal element emitting incident light of the second color as second emission light at a ratio corresponding to an applied voltage, and a synthesis unit configured to synthesize the first emission light and the second emission light, and emit the synthesized emission light as synthesized light, wherein the display control circuit includes a gray scale level conversion unit for, when a voltage applied to the first liquid crystal element corresponding to a gray scale level specified by the image data of the first color is less than a first threshold value, correcting the first data signal, to increase a voltage applied to the first liquid crystal element to be higher than a voltage corresponding to the gray scale level, and when a voltage applied to the second liquid crystal element corresponding to a gray scale level specified by the image data of the second color is less than a second threshold value, correcting the second data signal, to increase a voltage applied to the second liquid crystal element to be higher than a voltage corresponding to the gray scale level, performs overdrive processing for the first liquid crystal element when a voltage applied to the first liquid crystal element decreases due to a change in a gray scale level specified by the image data of the first color, and performs overdrive processing for the first liquid crystal element when a voltage applied to the second liquid crystal element decreases due to a change in a gray scale level specified by the image data of the second color.

BRIEF DESCRIPTION OF THE DRAWINGS

FIG. 4 is a diagram illustrating a relationship between image data pixels and panel pixels, and the like.

DESCRIPTION OF EXEMPLARY EMBODIMENTS

A liquid crystal projector of an exemplary embodiment will be described below with reference to the accompanying figures. Note that, in each figure, a size and a scale of each unit is different from the actual size and the actual scale of each unit as appropriate. Further, since the exemplary embodiment described below is a suitable specific example, various technically desirable limitations are added. Accordingly, the scope of the disclosure is not limited to the exemplary embodiment unless otherwise stated to limit the disclosure in the following descriptions.

Figure 1:
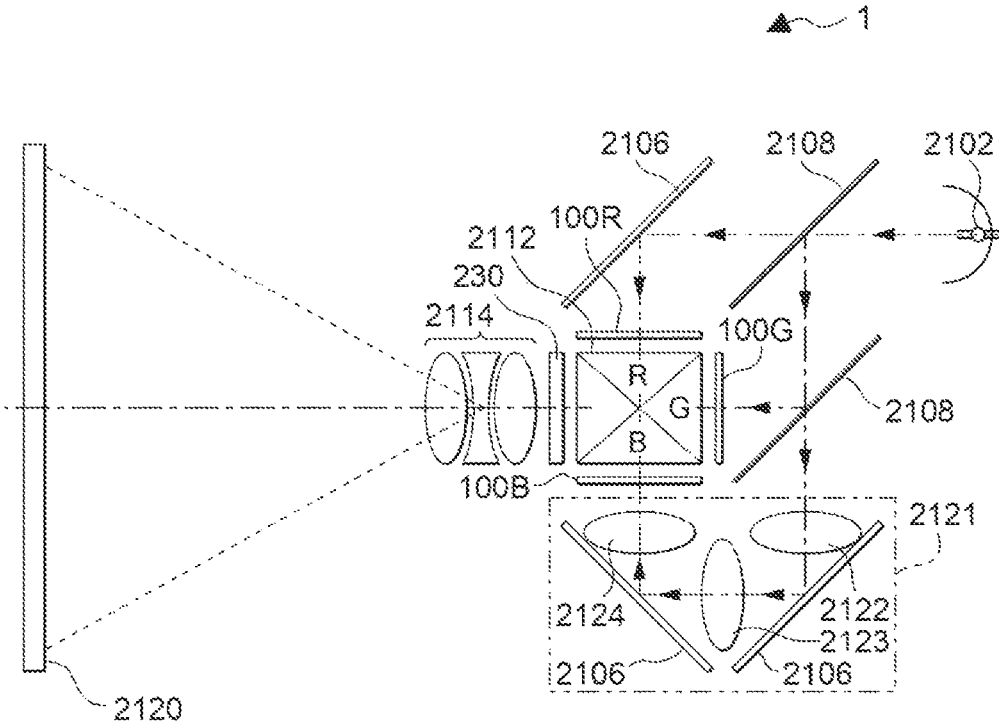
FIG. 1 is a diagram illustrating an optical configuration of a liquid crystal projector according to an exemplary embodiment.

FIG. 1 is a diagram illustrating an optical configuration of a liquid crystal projector 1 according to the exemplary embodiment. As illustrated in the figure, the liquid crystal projector 1 includes liquid crystal panels 100R, 100G, and 100B. Additionally, a light source unit 2102 including a light source such as a halogen lamp is provided inside the liquid crystal projector 1. Light emitted from this light source unit 2102 is split into three primary colors of R, G, and B by three mirrors 2106 and two dichroic mirrors 2108 installed inside. Of the light of the primary colors, light R is incident on the liquid crystal panel 100R, and light G is incident on the liquid crystal panel 100G, and light B is incident on the liquid crystal panel 100B. Note that, an optical path of B is long compared to an optical path of other R or G. Thus, the light B is guided to the liquid crystal panel 100B via a relay lens system 2121 formed of an incidence lens 2122, a relay lens 2123, and an emission lens 2124 to prevent a loss due to the optical path.

The liquid crystal panel 100R includes pixel circuits arrayed in a matrix as described below. In the pixel circuit described above, a transmittance of light emitted from a liquid crystal element is controlled based on a data signal corresponding to R. Therefore, in the liquid crystal panel 100R, emission light from the liquid crystal element functions as a pixel, which is a smallest unit of an image. By such control, the liquid crystal panel 100R generates a transmission image of R based on the data signal corresponding to R. Similarly, the liquid crystal panel 100G generates a transmission image of G based on a data signal corresponding to G, and the liquid crystal panel 100B generates a transmission image of B based on a data signal corresponding to B.

The transmission images of the respective colors generated by the respective liquid crystal panels 100R, 100G, and 100B are incident on a dichroic prism 2112 from three directions, respectively. Then, at the dichroic prism 2112, the light of R and the light of B are each refracted at 90 degrees, whereas the light of G travels in a straight line. Accordingly, the dichroic prism 2112 functions as a synthesis unit for synthesizing the images of the respective colors. Synthesized light by the dichroic prism 2112 is incident on a projection lens 2114 via a shifting device 230.

The projection lens 2114 expands and projects a synthesized image via the shifting device 230 onto a screen 2120. The shifting device 230 shifts an emission direction from the dichroic prism 2112. In particular, the shifting device 230 is able to shift an image projected onto the screen 2120, in left and right directions and up and down directions, with respect to a projection surface.

Figure 2:
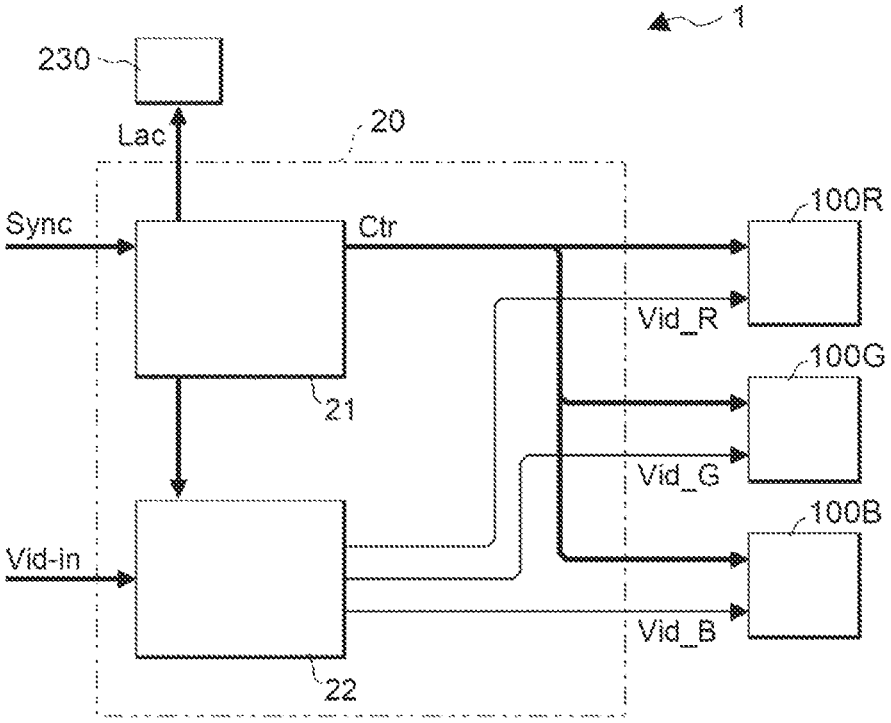
FIG. 2 is a block diagram illustrating an electrical configuration of the liquid crystal projector.

FIG. 2 is a block diagram illustrating an electrical configuration of the liquid crystal projector 1. As illustrated in the figure, the liquid crystal projector 1 includes a display control circuit 20, the liquid crystal panels 100R, 100G, 100B, and the shifting device 230.

The display control circuit 20 is supplied with image data Vid-in from a higher-level device such as a host device (not illustrated) in synchronization with a synchronizing signal Sync. The image data Vid-in is data indicating an image displayed on the liquid crystal projector 1, and specifies a gray scale level for a pixel of the image, for example, with eight bits per RGB.

The synchronization signal Sync includes a vertical synchronization signal instructing a start of vertical scanning in the image data Vid-in, a horizontal synchronization signal instructing a start of horizontal scanning, and a clock signal indicating timing for one pixel of the image data.

For convenience of description, in order to distinguish between a pixel for which a gray scale is specified by the image data Vid-in, and a pixel according to a synthesized image of the liquid crystal panels 100R, 100G and 100B, the pixel for which the gray scale is specified by the image data Vid-in is denoted as an image data pixel, and the pixel according to the liquid crystal panel 100R, 100G or 100B is denoted as a panel pixel.

Also, a position of a pixel projected onto the screen 2120 by synthesizing a panel pixel of R, a panel pixel of G, and a panel pixel of B, that is, a position of a panel pixel shifted by the shifting device 230, is simply denoted as a projection position.

In the present exemplary embodiment, a color image projected onto the screen 2120 is expressed by overlaying respective transmission images of the liquid crystal panels 100R, 100G, and 100B. Thus, a pixel that is a smallest unit of a color image can be divided into a red panel pixel by the liquid crystal panel 100R, a green panel pixel by the liquid crystal panel 100G, and a blue panel pixel by the liquid crystal panel 100B. Strictly speaking, the red panel pixel, the green panel pixel, and the blue panel pixel are each to be denoted as a sub-pixel, but in this description, denoted as a panel pixel as described above.

The liquid crystal panels 100R, 100G, and 100B differ in colors of incident light, that is, wavelengths, and substantially have common structure. Thus, when it is not necessary to specify a color, a reference numeral 100 will be used for description for the liquid crystal panels 100R, 100G, and 100G. Note that, as described below, the liquid crystal panels 100R, 100G, and 100G may have different optical responsiveness due to cell gaps, a temperature of a liquid crystal layer, and the like.

The display control circuit 20 includes a scanning control circuit 21, and an image processing circuit 22.

In the present exemplary embodiment, a pixel array of an image specified by the image data Vid-in is, for example, twice in a vertical direction, and twice in a horizontal direction, compared to an array of panel pixels in the liquid crystal panel 100. Thus, in the present exemplary embodiment, a projection direction is shifted by the shifting device 230, in order to increase pseudo resolution.

Specifically, a period for displaying one frame of the image indicated by image data Vid is divided into four fields, and the projection position is shifted for each field. Due to such a shift, one panel pixel is visually recognized as if displaying four pixels specified by the image data Vid-in.

Next, before describing the scanning control circuit 21 and the image processing circuit 22, a technique for representing four pixels specified by the image data Vid-in by one panel pixel in the liquid crystal panel 100 will be described.

Figure 3:
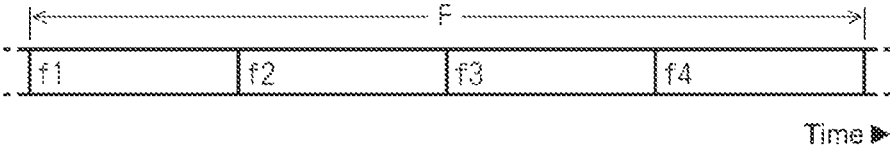
FIG. 3 is a diagram illustrating a relationship between a frame and fields.

FIG. 3 is a diagram for explaining a relationship between a frame and fields according to the present exemplary embodiment. As illustrated in the figure, a frame F is a period for displaying one frame. In the present exemplary embodiment, the frame F is divided into four fields. Note that, in order to distinguish the four fields in the frame F conveniently, reference numerals f1, f2, f3, and f4 are given in the order of time.

Note that, when a frequency of a vertical synchronization signal included in the synchronization signal Sync is 60 Hz, a period length of the frame F is 16.7 milliseconds of one cycle. In this case, a period length of each of the fields f1 to f4 is 4.17 milliseconds, which is ¼ of the period length of the one frame.

Next, a relationship among an image data pixel for which a gray scale level is specified by the image data Vid-in, a panel pixel by the liquid crystal panel 100, and a projection position by the shifting device 230 will be described.

Note that, the shifting device 230 shifts the projection direction from the dichroic prism 2112 as described above, but for convenience, a description will be given by converting an amount of the shift to a size of a projection pixel, that is, a panel pixel in the screen 2120.

Figure 4:
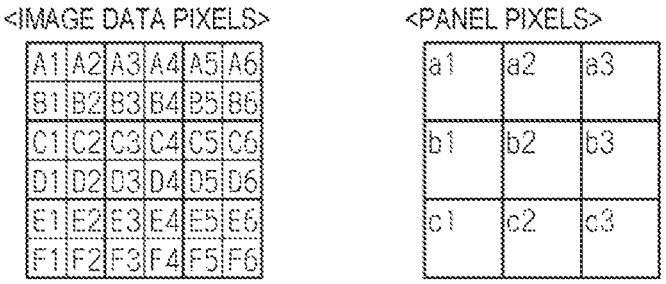

A left section in FIG. 4 is a diagram in which only some of image data pixels are extracted and illustrated. In addition, a right section in the figure is a diagram in which an array of the panel pixels corresponding to an array of the image data pixels in the left section are extracted and illustrated.

In the array in the left section in FIG. 4, in order to distinguish the image data pixels, for convenience, as reference numerals, A1 to A6, B1 to B6, C1 to C6, D1 to D6, E1 to E6, and F1 to F6 are given to a first row, a second row, a third row, a fourth row, a fifth row, and a sixth row, respectively. Similarly, in the array in the right section in FIG. 4, in order to distinguish the panel pixels, for convenience, as reference numerals, a1 to a3, b1 to b3, and c1 to c3 are given to a first row, a second row, and a third row, respectively.

Figure 5:
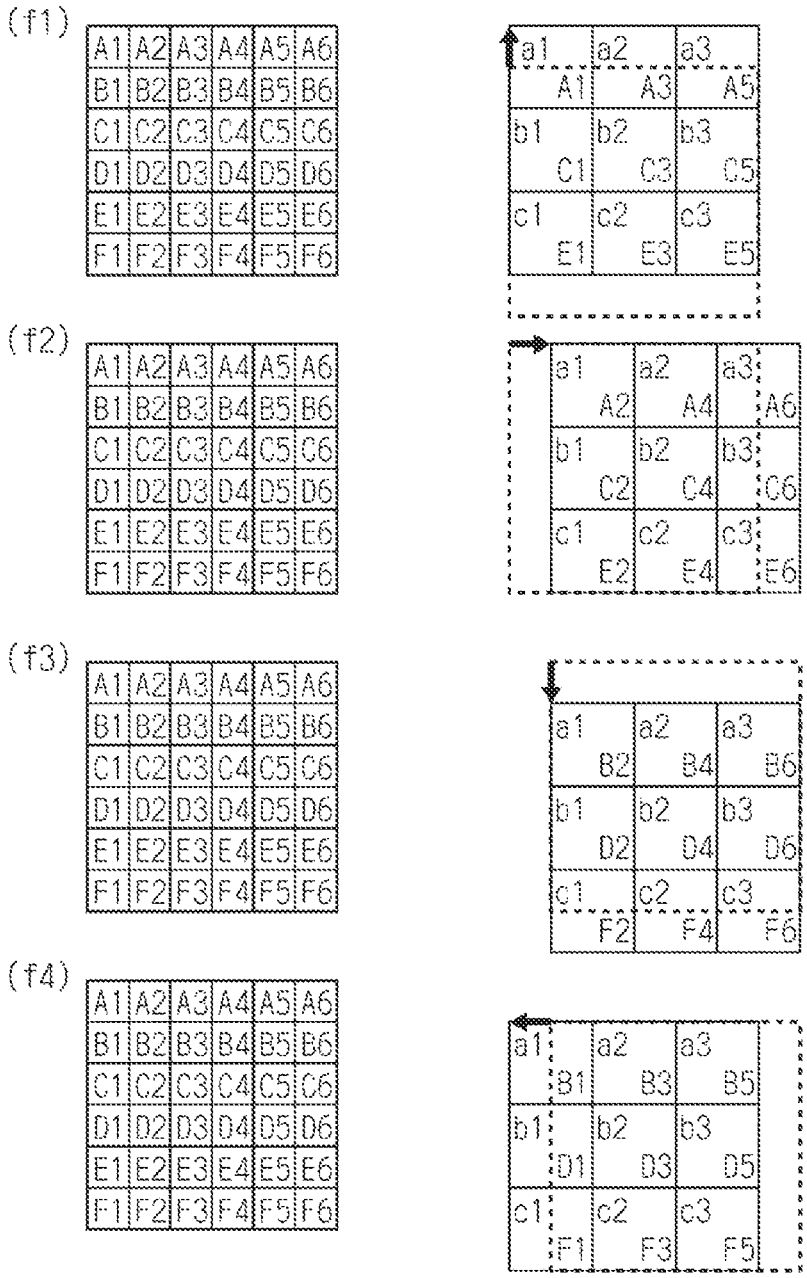
FIG. 5 is a diagram illustrating relationships between the image data pixels represented by the panel pixels and projection positions.

FIG. 5 is a diagram illustrating which of the image data pixels is displayed at which projection position by the panel pixel in the liquid crystal projector 1. Specifically, FIG. 5 is a diagram illustrating which of the image data pixels in the left section in FIG. 4 is displayed by nine of the panel pixels in the right section in FIG. 4 at which projection position in the fields f1 to f4.

For convenience of explanation, the projection position in the field f1 of the frame F is referred to as a reference position. In the field f1, the panel pixels a1 to a3, b1 to b3, and c1 to c3 in turn display the image data pixels A1, A3, A5, C1, C3, C5, E1, E3, and E5, respectively.

In the next field f2, the shifting device 230 shifts the projection position from the projection position in the field f1 indicated by a dashed line in a rightward direction in the figure by 0.5 pixels of the panel pixel. In addition, in the field f2, the panel pixels a1 to a3, b1 to b3, c1 to c3 in turn display the image data pixels A2, A4, A6, C2, C4, C6, E2, E4, and E6, respectively.

In the next field f3, the shifting device 230 shifts the projection position from the projection position in the field f2 indicated by the dashed line in a downward direction in the figure by 0.5 pixels of the panel pixel. In addition, in the field f3, the panel pixels a1 to a3, b1 to b3, c1 to c3 in turn display the image data pixels B2, B4, B6, D2, D4, D6, F2, F4, and F6, respectively.

Then, in the next field f4, the shifting device 230 shifts the projection position from the projection position in the field f3 indicated by the dashed line in a leftward direction in the figure by 0.5 pixels of the panel pixel. Additionally, in the field f4, the panel pixels a1 to a3, b1 to b3, c1 to c3 in turn display the image data pixels B1, B3, B5, D1, D3, D5, F1, F3, and F5, respectively.

After the field f4, the shifting device 230 shifts the projection position from the projection position in the field f4 indicated by the dashed line in an upward direction in the figure back to the position in the field f1 by 0.5 pixels of the panel pixel.

Referring again to FIG. 2, the scanning control circuit 21 generates a control signal Ctr for controlling scanning of the liquid crystal panels 100R, 100G, and 100B per field. Further, the scanning control circuit 21 generates a control signal Lac in order for controlling the projection position by the shifting device 230 per field.

Although details will be described later, the image processing circuit 22 temporarily accumulates the image data Vid-in, and reads out image data corresponding to the panel pixels to be displayed in the field, of the accumulated image data Vid-in. Furthermore, the image processing circuit 22 processes the read image data separately per color, converts to analog, and outputs the image data as data signals Vid_R, Vid_G, and Vid_B. Of these, the data signal Vid_R is a signal obtained by processing a component of R of the image data Vid-in, and is supplied to the liquid crystal panel 100R. Similarly, the data signal Vid_G is a signal obtained by processing a component of G of the image data Vid-in, and is supplied to the liquid crystal panel 100G. The data signal Vid_B is a signal obtained by processing a component of B of the image data Vid-in, and is supplied to the liquid crystal panel 100B.

Next, the liquid crystal panels 100R, 100G, and 100G will be generally described without specifying a color.

Figure 6:
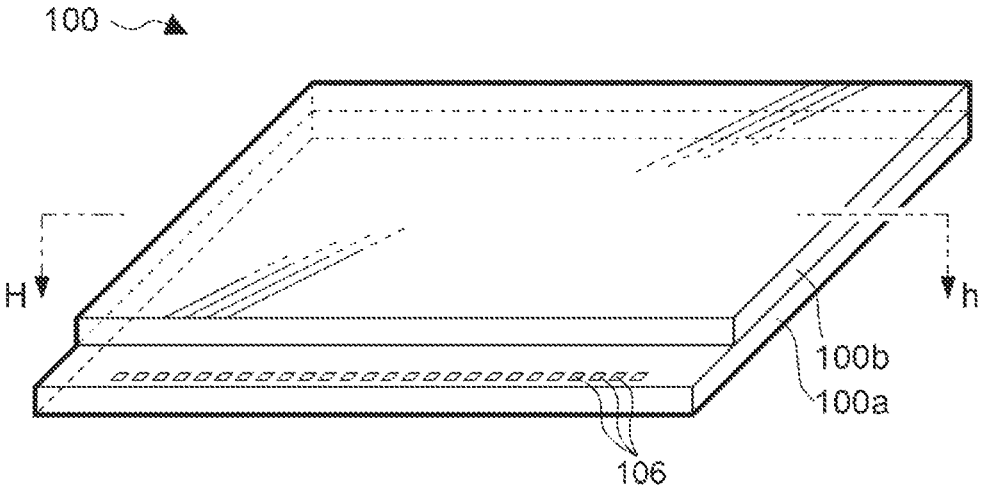
FIG. 6 is a perspective view of a liquid crystal panel in the liquid crystal projector.
Figure 7:
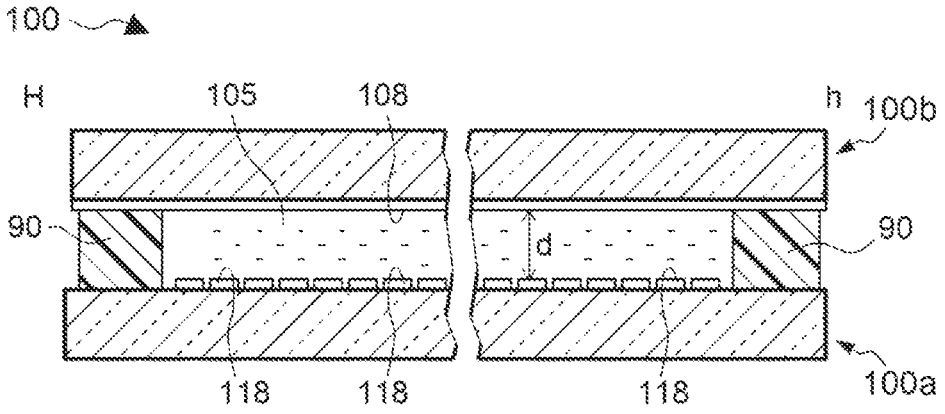
FIG. 7 is a cross-sectional view illustrating structure of the liquid crystal panel.

FIG. 6 is a diagram illustrating a main part of the liquid crystal panel 100, and FIG. 7 is a cross-sectional view taken along a line H-h in FIG. 6.

As illustrated in these figures, in the liquid crystal panel 100, an element substrate 100*a* provided with pixel electrodes 118 and a counter substrate 100*b* provided with a common electrode 108 are bonded such that electrode forming surfaces face each other while a constant gap is kept by a sealing material 90 including a spacer (not illustrated), and a liquid crystal 105 is sealed in this gap. Note that, a length of the gap between the element substrate 100*a* and the counter substrate 100*b* is generally referred to as a cell gap. In the figure, the cell gap is denoted by a reference numeral d.

For each of the element substrate 100*a* and the counter substrate 100*b*, a substrate having optical transparency, such as glass or quartz is used. As illustrated in FIG. 6, one side of the element substrate 100*a* protrudes from the counter substrate 100*b*. A plurality of terminals 106 are provided in this protruding region along the one side. One end of an FPC substrate (not illustrated) is connected to the plurality of terminals 106. Another end of the FPC substrate is connected to the display control circuit 20, and is supplied with the various signals described above and the like.

A surface of the element substrate 100*a* facing the counter substrate 100*b* is formed with the pixel electrodes 118 by patterning a conductive layer having transparency such as ITO, for example. Note that, ITO is an abbreviation for Indium Tin Oxide.

Also, an opposing surface of the element substrate 100*a* and an opposing surface of the counter substrate 100*b* are provided with various elements other than the electrodes, but the various elements are omitted in the figure.

Figure 8:
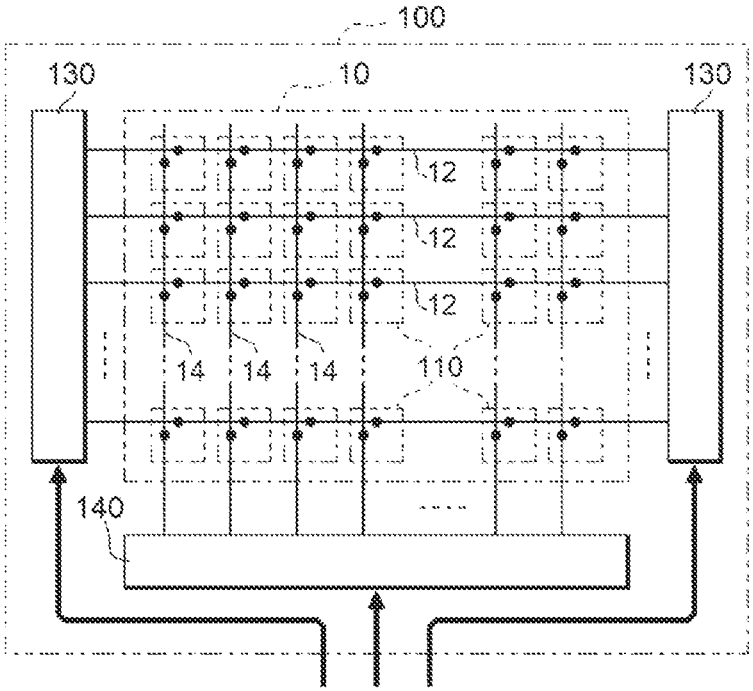
FIG. 8 is a block diagram illustrating an electrical configuration of the liquid crystal panel.

FIG. 8 is a block diagram illustrating an electrical configuration of the liquid crystal panel 100. The liquid crystal panel 100 is provided with a scanning line drive circuit 130 and the data line drive circuit 140 on a periphery of a display region 10.

In the display region 10 of the liquid crystal panel 100, pixel circuits 110 are arrayed in a matrix. Specifically, in the display region 10, a plurality of scanning lines 12 are provided extending in a horizontal direction in the figure, and a plurality of data lines 14 extend in a vertical direction in the figure, and are provided so as to be mutually and electrically isolated from the scanning lines 12. Then, the pixel circuits 110 are arrayed in a matrix, corresponding to intersections between the plurality of scanning lines 12 and the plurality of data lines 14.

When the number of scanning lines 12 is m, and the number of data lines 14 is n, the pixel circuits 110 are arrayed in a matrix of vertical m rows by horizontal n columns. Both n and m are integers equal to or greater than 2. In the scanning lines 12 and the pixel circuits 110, in order to distinguish the rows of the matrix from each other, the rows may be referred as a 1st, a 2nd, a 3rd, . . . , an (m−1)-th, and an m-th row in order from a top in the figure. Similarly, to distinguish the columns of the matrix from each other in the data lines 14 and the pixel circuits 110, the columns may be referred as a 1st, a 2nd, a 3rd, . . . , an (n−1)-th, and an n-th column in order from a left in the figure.

In accordance with control by the scanning control circuit 21, the scanning line drive circuit 130 selects the scanning lines 12 in an order of, for example, the 1st, 2nd, 3rd, . . . , m-th row, one at a time, and sets a scanning signal to the selected scanning line 12 to an H level. Note that, the scanning line drive circuit 130 sets a scanning signal to the scanning line 12 other than the selected scanning line 12 to an L level.

The data line drive circuit 140 latches a data signal for one row supplied from the image processing circuit 22 in accordance with the control by the scanning control circuit 21, and outputs the data signal to the pixel circuit 110 located in the scanning line 12 via the data line 14, during a period in which the scanning signal to the scanning line 12 is set to the H level.

Figure 9:
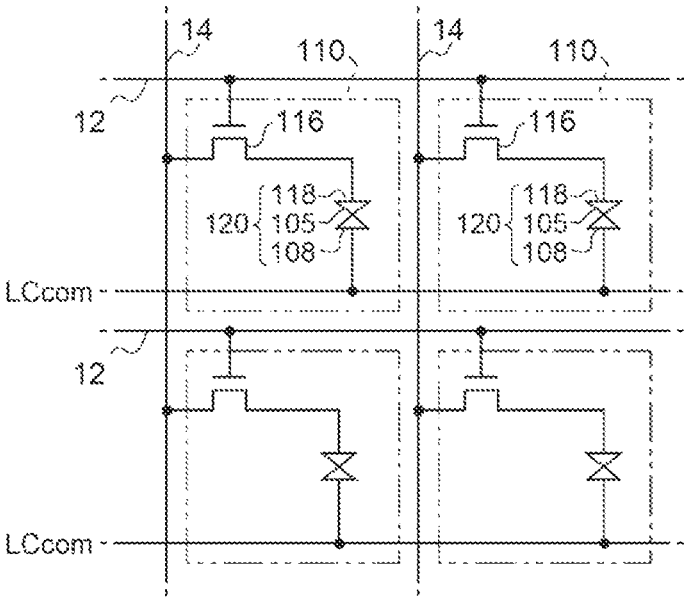
FIG. 9 is a diagram illustrating a configuration of a pixel circuit in the liquid crystal panel.

FIG. 9 is a diagram illustrating an equivalent circuit of a total of four of the pixel circuits 110, which are in two rows by two columns corresponding to intersections between the two adjacent scanning lines 12 and the two adjacent data lines 14.

As illustrated in the figure, the pixel circuit 110 includes a transistor 116 and a liquid crystal element 120. The transistor 116 is, for example, an n-channel type thin film transistor. In the pixel circuit 110, a gate node of the transistor 116 is connected to the scanning line 12, while a source node thereof is connected to the data line 14, and a drain node thereof is connected to the pixel electrode 118 having a substantially square shape in plan view.

Commonly for all the pixel circuits, the common electrode 108 is provided so as to face the pixel electrode 118. A voltage LCcom is applied to the common electrode 108. Then, the liquid crystal 105 is sandwiched between the pixel electrode 118 and the common electrode 108 as described above. Accordingly, for each of the pixel circuits 110, the liquid crystal element 120 that sandwiches the liquid crystal 105 by the pixel electrode 118 and the common electrode 108 is configured.

Note that, a storage capacitor may be provided in parallel to the liquid crystal element 120, but is not important in this case, thus is omitted.

In the scanning line 12 for which the scanning signal is set to the H level, the transistor 116 of the pixel circuit 110 provided corresponding to the scanning line 12 is turned on. Since the transistor 116 is turned on, the data line 14 and the pixel electrode 118 are brought into a state of being electrically connected, and thus a data signal supplied to the data line 14 reaches the pixel electrode 118 via the turned-on transistor 116. When the scanning line 12 is set to the L level, then the transistor 116 is turned off, and a voltage of the data signal reached to the pixel electrode 118 is retained by capacitance of the liquid crystal element 120.

As is commonly known, in the liquid crystal element 120, an orientation of liquid crystal molecules varies in accordance with an electric field generated by the pixel electrode 118 and the common electrode 108. Thus, the liquid crystal element 120 has a transmittance in accordance with a voltage effective value of a difference between the voltage of the data signal and the voltage LCcom of the common electrode 108. Note that, in the present exemplary embodiment, the liquid crystal element 120 is in a normally black mode where a transmittance increases as the voltage effective value increases.

Operation of supplying data signals to the pixel electrodes 118 of the liquid crystal elements 120 is performed in an order of the 1st, 2nd, 3rd, . . . , m-th row, and thus, a voltage corresponding to the data signal is retained in each of the liquid crystal elements 120 of the pixel circuits 110 arrayed in the m rows by n columns. Since the voltage is retained in this manner, each liquid crystal element 120 has a targeted transmittance, thus a transmission image of corresponding colors is generated by the pixels arrayed in the m rows by n columns.

Figure 10:
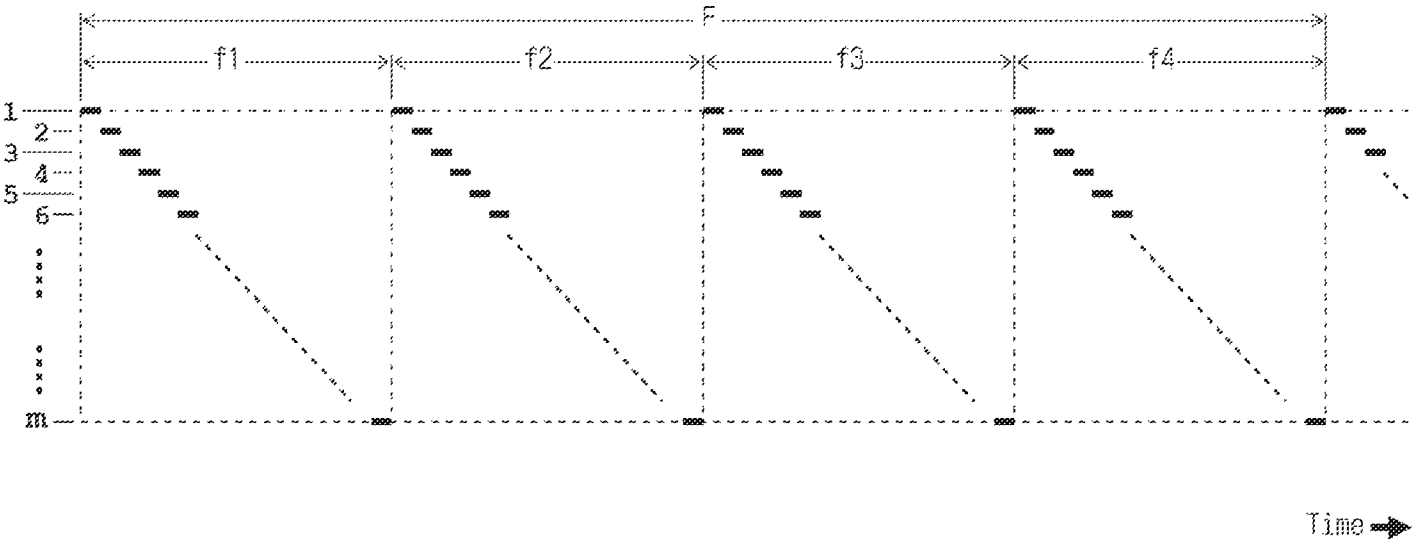
FIG. 10 is a diagram illustrating a transition of scanning line selection in the liquid crystal panel.

Note that, FIG. 10 is a diagram illustrating a temporal transition of the selected scanning line 12, when a vertical axis indicates the 1st row to the m-th row, and a horizontal axis indicates elapsed time, where m is the number of rows of the scanning line 12.

When selection of the scanning line 12 is indicated by a black thick line, the scanning lines 12 are exclusively selected one row at a time, and thus the selected scanning line 12 sequentially transitions from the 1st line to the m-th line with the elapse of time.

When a certain scanning line 12 is selected in a certain field, a data signal corresponding to the field and the panel pixel is supplied from a certain data line 14 to the pixel circuit 110 corresponding to an intersection of the scanning line 12 and the data line 14. Thus, in the field, a transmittance of the liquid crystal element 120 of the pixel circuit 110 changes to a transmittance corresponding to a voltage of the data signal.

Incidentally, optical responsiveness of the liquid crystal panel 100R, 100G, and 100B, specifically, transmittance responsiveness to a change in a voltage applied to the liquid crystal element 120 may vary depending on various factors.

Examples of the factors include a difference in the cell gap d in the liquid crystal panels 100R, 100G, and 100G. Specifically, the smaller the cell gap d, the better the optical responsiveness. In the present exemplary embodiment, the cell gap d of the liquid crystal panel 100G is, for example, approximately 25% less than the cell gap d of the liquid crystal panels 100R and 100B. Thus, the optical responsiveness is substantially the same for the liquid crystal panels 100R and 100B, and is lower than the optical responsiveness of the liquid crystal panel 100G. In other words, the optical responsiveness of the liquid crystal panel 100G is higher than the optical responsiveness for the liquid crystal panels 100R and 100B.

Note that, as another example of the factor, there is temperature differences of the liquid crystal panels 100R, 100G and 100B, specifically, a difference of a temperature of the liquid crystal 105. When temperature increases, viscosity of the liquid crystal 105 decreases, and thus optical responsiveness of the liquid crystal element 120 is improved, that is, a response speed is increased. Specifically, in the liquid crystal projector 1 illustrated in FIG. 1, an amount of incident light on the liquid crystal panel 100G is greater than an amount of incident light on the liquid crystal panel 100R and the liquid crystal panel 100B. Thus, the temperature of the liquid crystal panel 100G tends to be higher than the temperature of the liquid crystal panel 100R and the liquid crystal panel 100B.

On the other hand, in a hold-type display element such as the liquid crystal element 120, a blur is likely to occur when displaying a moving image. In order to reduce such a blur, in the present exemplary embodiment, the image processing circuit 22 performs overdrive processing. The overdrive processing refers to a process, when a gray scale level of a pixel specified by image data changes from one value to another value, to change a transmittance of a panel pixel, for applying a voltage that is excessively shifted in a change direction, rather than a voltage corresponding to a gray scale level after change, to a liquid crystal element of the panel pixel.

Figure 11:
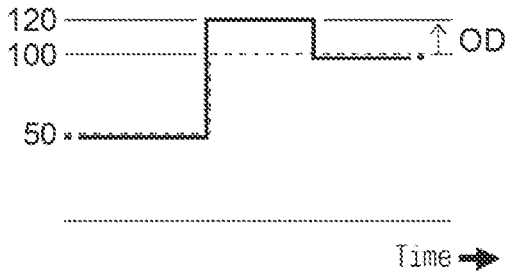
FIG. 11 is a diagram illustrating operation of a tr correction.

For example, a gray scale level corresponding to a certain panel pixel is, for example, increased from "50" to "100", the overdrive processing changes an applied voltage to the liquid crystal element 120 of the panel pixel as illustrated in FIG. 11. Specifically, in the overdrive process, when a gray scale level changes, the liquid crystal element 120 of the panel pixel is applied, rather than with a voltage corresponding to a gray scale level of "100" indicated by a dashed line, but with a voltage corresponding to, for example, "120", which is an amount excessively shifted in an increase direction, as indicated by a solid line.

Figure 12:
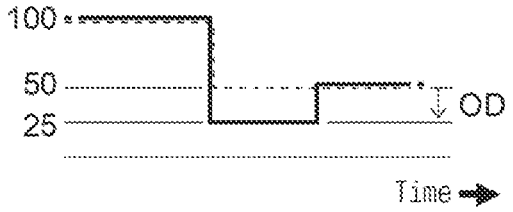
FIG. 12 is a diagram illustrating operation of a tf correction.
Figure 13:
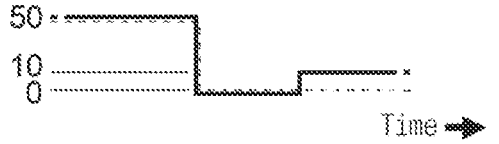
FIG. 13 is a diagram illustrating operation of a black floating process.
Figure 14:
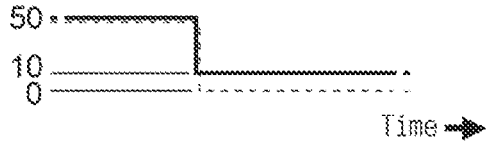
FIG. 14 is a diagram illustrating operation when the tf correction and the black floating process are combined.

Note that, in FIG. 12 to FIG. 14 that follow, including FIG. 11, the voltage applied to the liquid crystal element 120 is converted to a gray scale level, and indicated. Here, the voltage applied to the liquid crystal element 120 is an absolute value of a difference between a voltage of a data signal applied to the pixel electrode 118 and the voltage LCcom applied to the common electrode 108.

Furthermore, even when the voltage illustrated in the figure is applied to the liquid crystal element 120, a transmittance cannot immediately follow a change in voltage to change.

The amount excessively shifted compared to the gray scale level after the change may be referred to as an amount of overdrive OD.

When the gray scale level is increased in this manner, that is, when in the normally black mode, the overdrive processing when the applied voltage to the liquid crystal element 120 is increased is referred to as a tr correction.

Also, when the gray scale level of "100" corresponding to the panel pixel continues, a voltage corresponding to this "100" is applied to the liquid crystal element 120.

On the other hand, a gray scale level corresponding to a certain panel pixel is, for example, decreased from "100" to "50", the overdrive processing changes an applied voltage to the liquid crystal element 120 of the panel pixel as illustrated in FIG. 12. Specifically, in the overdrive process, when a gray scale level changes, the liquid crystal element 120 of the panel pixel is applied, rather than with a voltage corresponding to a gray scale level of "50" indicated by a dashed line, but with a voltage corresponding to, for example, "25", which is an amount excessively shifted in a decrease direction, as indicated by a solid line.

When the gray scale level is decreased in this manner, that is, when in the normally black mode, the overdrive processing when the applied voltage to the liquid crystal element 120 is decreased is referred to as a tf correction.

The amount of overdrive depends on the gray scale level before change and the gray scale level after change. Therefore, a configuration is common where the amount of overdrive is output by a look-up table (LUT), an operation, or the like using a gray scale level before change and a gray scale value after change as arguments.

As described above, the optical responsiveness differs in the liquid crystal panels 100R, 100G, and 100B.

Specifically, the optical responsiveness of the liquid crystal panel 100G is better than the optical responsiveness of the liquid crystal panel 100R and 100B.

Therefore, applying an equivalent overdrive processing for RGB may result in different transmittances for RGB due to differences in the optical responsiveness. Specifically, even when a change to the same gray scale level is attempted for RGB, the differences in the optical responsiveness result in different transmittances for RGB, and there is a problem that a specific color is colored and visually recognized so as to be highlighted, although an achromatic color is to be visually recognized.

Such coloring cannot be improved by simply causing the amount of overdrive to be different for each of RGB in some cases. Thus, in the present exemplary embodiment, a configuration is adopted in which, firstly, both the tf correction when the gray scale levels increase, and the tf correction when gray scale levels decrease, of the overdrive processing are performed for R and B, and only the tr correction is performed and the tf correction is not performed, of the overdrive process, for G.

Of the overdrive process, the tr correction is performed for any of RGB, but when a gray scale level increases from a state lower than a certain value, a tendency of optical responsiveness to decrease, specifically, a tendency to take time to change from a dark state to a light state is strong. Thus, in the present exemplary embodiment, secondly, a so-called black floating process is also performed in addition to the overdrive process.

The black floating process refers to a process for, when a gray scale level of a certain panel pixel is "0" which is minimum, applying a voltage of a slightly high initial voltage (for example, 1 V), rather than a minimum voltage of 0 V, to the liquid crystal element 120 of the panel pixel.

When a gray scale level specified for a panel pixel is "0", in particular when displaying a moving image, a possibility is high that a gray scale level that is specified next is other than 0. Therefore, according to the black floating process, even when a gray scale level specified for a panel pixel in a certain field is "0", the gray scale level is replaced with, for example, "10" corresponding to the initial voltage so that the gray scale level after change can be responded quickly.

More specifically, when a liquid crystal is of a VA type, for example, when a voltage applied to the liquid crystal element 120 is 0 V, liquid crystal molecules are arrayed in a substantially substrate vertical direction. In this array state, even when the gray scale level changes and the applied voltage to the liquid crystal element 120 increases, the liquid crystal molecules are not easily inclined toward a direction of an orientation process applied to the substrate, and thus optical responsiveness is poor.

Thus, when the gray scale level is "0", the initial voltage is applied to the liquid crystal element 120 so that the liquid crystal molecules are not arrayed in the substrate vertical direction, but are slightly inclined with respect to the substrate vertical direction. According to this black floating process, since the liquid crystal molecules easily follow subsequent changes in the gray scale level, and are inclined, thus optical responsiveness is improved.

Note that, even when the gray scale level is "0", the initial voltage is applied to the liquid crystal element 120, thus a transmittance is not minimized, and a state where black is floating occurs. Therefore, the process is referred to as the black floating process in a sense of causing black to float. In addition, the black floating process is also performed, even when the gray scale level is other than "0", in other words, when the gray scale level is less than a threshold value. The threshold value of the black floating process may be different for each of R, G, and B, or may be the same.

In addition, in the black floating process, when a voltage applied to the liquid crystal element 120 corresponding to a gray scale level specified by image data is less than the threshold value, that is, when the gray scale level is less than the threshold value, the applied voltage to the liquid crystal element 120 is increased to be higher than a voltage corresponding to the gray scale level. In other words, it can be said that the black floating process is a process for correcting a data signal so that a voltage applied to the liquid crystal element 120 is increased to be higher than a voltage corresponding to a gray scale level specified by image data.

When the tf correction of the overdrive processing and the black floating process are combined for R and B, specifically, when a gray scale level of a panel pixel is specified in an order of "50", "0", and "0", an applied voltage to the liquid crystal element 120 is as follows. That is, in this case, as illustrated in FIG. 13, the applied voltage to the liquid crystal element 120 is sequentially a voltage corresponding to a gray scale level "50", a voltage corresponding to a gray scale level "0" due to the tf correction, and a voltage corresponding to a gray scale level "10" due to the black floating process. Note that, the voltage corresponding to the gray scale level "10" is the initial voltage described above.

On the other hand, when the tf correction of the overdrive processing is not performed and the black floating process is performed for G, and similarly when a gray scale level of a panel pixel is specified in an order of "50", "0", and "0", the applied voltage to the liquid crystal element 120 is as follows. That is, in this case, as illustrated in FIG. 14, the applied voltage to the liquid crystal element 120 is sequentially a voltage corresponding to the gray scale level "50", a voltage corresponding to the gray scale level "10" which is corrected by the black floating process, and a voltage corresponding to the gray scale level "10" which is corrected by the black floating process.

Note that, when the gray scale level of "0" is replaced with the gray scale level of "10" corresponding to the initial voltage by the black floating process, and a next specified gray scale level is increased to "50", the gray scale level before change is not "0", but is the replaced gray scale level "10".

The image processing circuit 22 that performs the overdrive processing and the black floating process differently for R, B, and G will be described.

Figure 15:
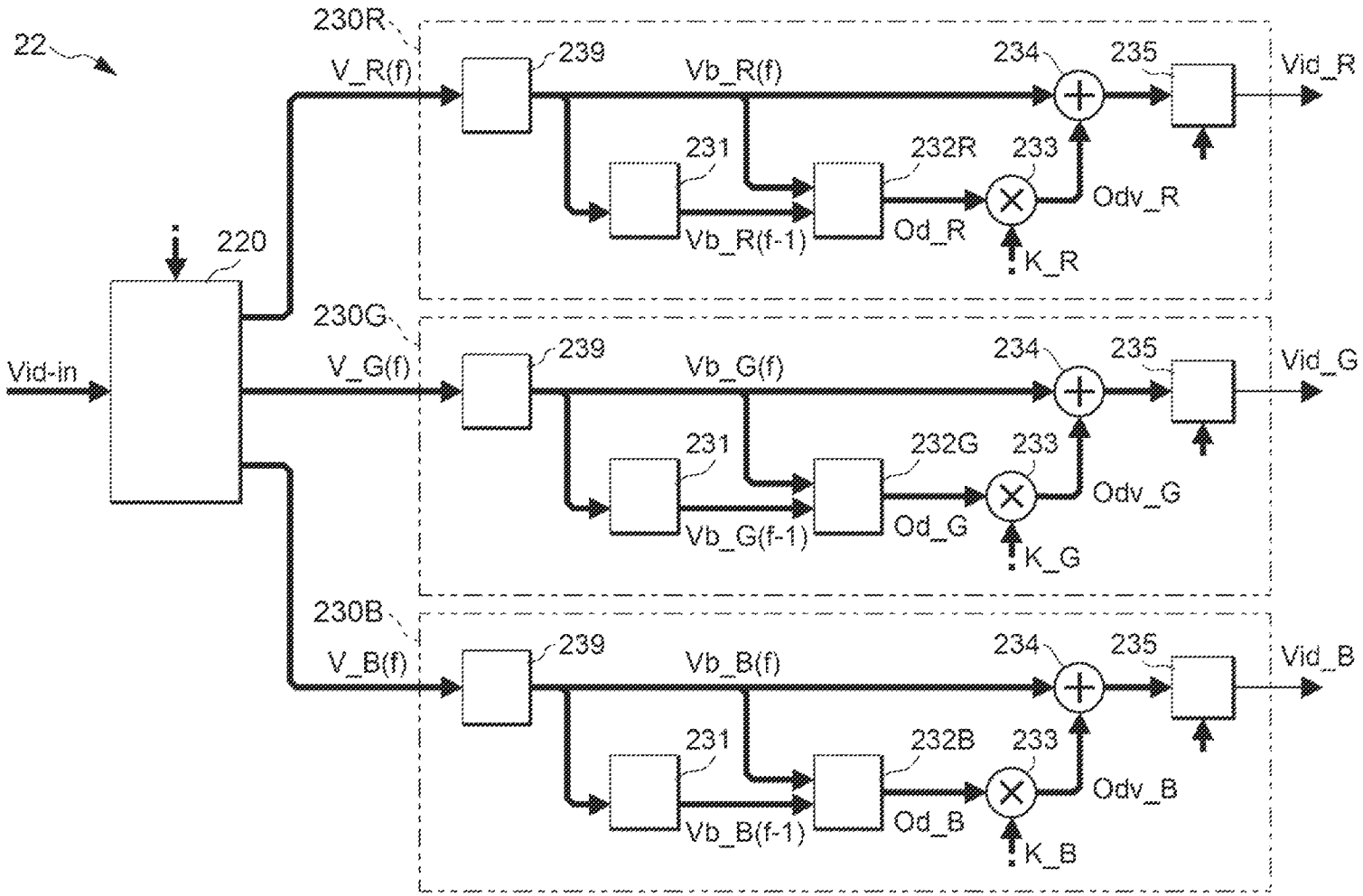
FIG. 15 is a block diagram illustrating a configuration of an image processing circuit.

FIG. 15 is a block diagram illustrating a configuration of the image processing circuit 22. As illustrated in the figure, the image processing circuit 22 includes a frame memory 220, processing circuits 230R, 230G, and 230B.

The frame memory 220 is used to accumulate the image data Vid-in, and read image data corresponding to a field. Specifically, the image data Vid-in is accumulated in the frame memory 220 in accordance with control by the scanning control circuit 21 (see FIG. 2). Then, from the frame memory 220, the image data Vid-in displayed with panel pixels in a certain field is read by the scanning control circuit 21 in accordance with scanning timing.

Specifically, the image data Vid-in as the following is read from the frame memory 220. For example, when the scanning line 12 in the 1st row is selected in the field f1, the image data Vid-in is read that corresponds to the image data pixels A1, A3, A5, . . . , among the image data pixels in the left section of FIG. 4. When the scanning line 12 in the 2nd row is selected in the field f1, the image data Vid-in corresponding to the image data pixels C1, C3, C5, . . . , is read. Further, for example, when the scanning line 12 in the 1st row is selected in the field f2, the image data Vid-in corresponding to the image data pixels A2, A4, A6, . . . , is read. In addition, when the scanning line 12 in the 2nd row is selected in the field f2, the image data Vid-in corresponding to the image data pixels C2, C4, C6, . . . , is read.

In this way, the image data Vid-in displayed with panel pixels is read from the frame memory 220 in a certain field.

A component of R of the image data Vid-in read from the frame memory 220 is supplied to the processing circuit 230R as image data V_R(f). Similarly, of the image data Vid-in read from the frame memory 220, a component of G is supplied to the processing circuit 230G as image data V_G(f), and a component of B is supplied to the processing circuit 230B as image data V_B(f).

The processing circuit 230R includes a delay device 231, an LUT 232R, a multiplier 233, an adder 234, a DA converter 235, and a gray scale level converter 239.

The gray scale level converter 239 in the processing circuit 230R performs the black floating process for the image data V_R(f), and outputs the data subjected to the black floating process as image data Vb_R(f). Specifically, when a gray scale level specified for a panel pixel in the current field is less than a threshold value, the gray scale level converter 239 replaces the gray scale level with the threshold value. For example, when the threshold value is set to "10", and a gray scale level specified by the image data V_R(f) is "0" to "9", the gray scale level converter 239 replaces the gray scale level with "10" and outputs the gray scale level as the image data Vb_R(f).

Note that, the gray scale level of "10" referred here is a value that causes an applied voltage to the liquid crystal element 120 to be the initial voltage for the black floating if being converted to analog by the DA converter 235.

In addition, when a gray scale level specified for a panel pixel in the current field is equal to or greater than the threshold value, the gray scale level converter 239 outputs, without conversion, the gray scale level specified by the image data V_R(f), as is, as image data Vb_R(f).

The delay device 231 in the processing circuit 230R delays the image data Vb_R(f) by a period corresponding to one field and outputs the image data Vb_R(f) as image data Vb_R(f−1). Note that, (f−1) indicates a previous field of (f) and corresponds to the same panel pixel. Also, the reason why the image data V_R(f) is delayed by the period corresponding to one field and output as the image data Vb_R (f−1) is to compare with a gray scale level specified by the image data Vb_R(f) for a certain panel pixel and to determine an amount of change.

The LUT 232R in the processing circuit 230R is a look-up table in which an amount of overdrive, with a gray scale level in the current field and a gray scale level in the previous field as arguments, is stored in advance for R.

Note that, in the LUT 232R in R, amounts of overdrive are stored for both cases when the gray scale level of the current field indicated by the image data Vb_R(f) is increased from the gray scale level in the previous field, and when the gray scale level is decreased. From the LUT 232R, data Od_R is output that corresponds to the gray scale level indicated by the image data Vb_R(f) and the gray scale level indicated by the image data Vb_R(f−1). Note that, the data Od_R is, when viewed as a decimal value, a positive value when the gray scale level increases, a negative value when the gray scale level decreases, and is zero when the gray scale level does not change.

The multiplier 233 in the processing circuit 230R multiplies the data Od_R by a coefficient K_R, and outputs a result of the multiplication as data Odv_R as a correction amount. Note that, the coefficient K_R may be optionally set in a decimal value range from "0" to "1", but may be set to be greater than "1" when a liquid crystal response slows, due to an ambient temperature and the like. Here, for convenience of explanation, "1" is an initial value.

The adder 234 in the processing circuit 230R adds the data Odv_R to the image data Vb_R(f). Note that, as described above, the data Od_R and Odv_R may take a negative value, and thus, actual computation contents in the adder 234 include not only addition, but also subtraction.

The DA converter 235 converts an addition result by the adder 234 into a data signal Vid_R of an analog voltage having a polarity specified by the scanning control circuit 21.

In this manner, the processing circuit 230R performs the black floating process for the image data V_R(f) of a component of R, of the image data Vid-in, and performs the overdrive processing both when a gray scale level specified for a panel pixel increases and decreases.

Then, the processing circuit 230R converts the image data subjected to the black floating process and the overdrive processing to analog, and outputs a result of the conversion to the liquid crystal panel 100R as the data signal Vid_R.

The processing circuit 230B corresponding to B is also similar to the processing circuit 230R. Specifically, the processing circuit 230B performs the black floating process for the image data V_B(f) of a component of B, of the image data Vid-in, and performs the overdrive processing both when a gray scale level specified for a panel pixel increases and decreases.

Then, the processing circuit 230B converts the image data subjected to the black floating process and the overdrive processing to analog, and outputs a result of the conversion to the liquid crystal panel 100B as the data signal Vid_B.

The processing circuit 230G corresponding to G is different from the processing circuits 230R and 230B. In particular, the processing circuit 230G, similar to the processing circuits 230R and 230B, performs the black floating process for the image data V_G(f) of a component of R, of the image data Vid-in, the overdrive processing and analog conversion, and outputs a result of the conversion to the liquid crystal panel 100G as the data signal Vid_G, but performs only the tr correction of the overdrive processing when a gray scale level specified for a panel pixel increases, and does not perform the tf correction when the gray scale level decreases.

Specifically, the LUT 232G in the processing circuit 230G stores an amount of overdrive, only when a gray scale level in the current field increases from a gray scale level in the previous field. Therefore, a configuration is adopted in which, in the LUT 232G, when a gray scale level decreases and does not change, zero is output as an amount of overdrive.

Note that, the coefficients K_R, K_G, and K_B are supplied by, for example, the scanning control circuit 21 in a changeable manner. The coefficients K_G and K_B, similarly to the coefficient K_R, may be optionally set in a decimal value range from "0" to "1", but may be set to be greater than "1". For convenience of explanation, "1" is an initial value.

The amount of overdrive may be determined by calculation, rather than the conversion by the LUT 232R, 232G or 232B.

The present exemplary embodiment is configured to perform both the tr correction and the tf correction of the overdrive processing for R and B, perform the tr correction without performing the tf correction for G, and further perform the black floating process for R, G, and B. For superiority of such a configuration, a description will be given using a case where a certain display is performed as an example.

Figure 16:
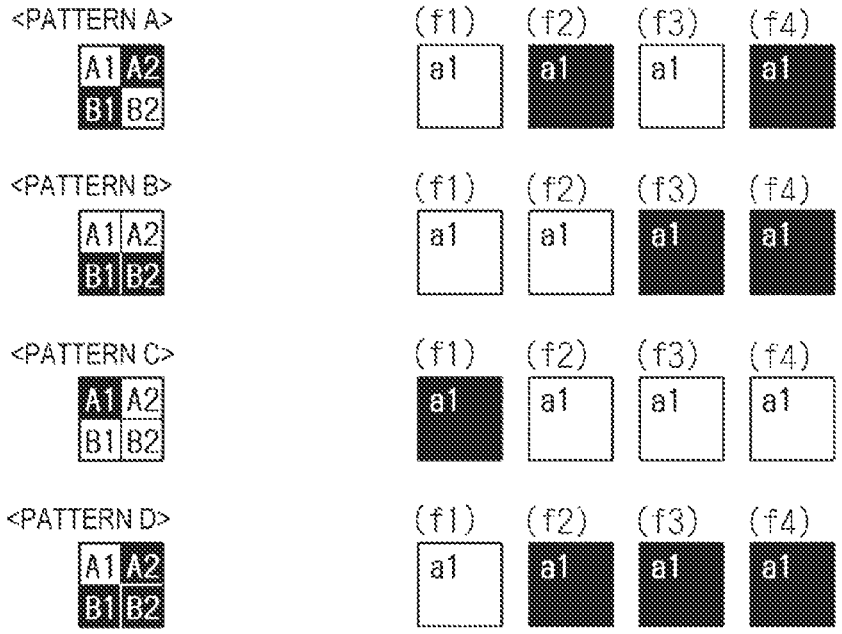
FIG. 16 is a diagram illustrating a display example of the panel pixels.

FIG. 16 is a diagram illustrating an example of display contents of image data pixels A1, A2, B2, and B1, and display contents of panel pixels corresponding to the image data pixels A1, A2, and B2.

In the figure, a pattern A is a case where the display contents of the image data pixels A1, A2, B2, and B1 become white, black, white, and black in this order. In this case, the panel pixel repeats white and black per field. Note that, "white" referred to here means that a maximum value of a gray scale level is specified for image data, and a maximum value of a transmittance is specified for the panel pixel. Further, "black" referred to here means that a minimum value of a gray scale level is specified for image data, and a minimum value of a transmittance is specified for the panel pixel.

A pattern B is a case where the display contents of the image data pixels A1, A2, B2, and B1 become white, white, black, and black in this order. In this case, in the panel pixel, white continues in the fields f1 and f2, and then black continues in the fields f3 and f4.

A pattern C is a case where the display contents of the image data pixels A1, A2, B2, and B1 become black, white, white, and white in this order. In this case, in the panel pixel, after black in the field f1, white continues in the fields f2, f3, and f4.

A pattern D is a case where the display contents of the image data pixels A1, A2, B2, and B1 become white, black, black, and black in this order. In this case, in the panel pixel, after white in the field f1, black continues in the fields f2, f3, and f4.

FIG. 17 to FIG. 20 are diagrams illustrating how a transmittance of a panel pixel changes for each of R, G, and B, when the pattern A, pattern B, pattern C, and pattern D are used.

Note that in FIG. 17 to FIG. 20, a comparative example is an example when only the tr correction is performed, and the tf correction and the black floating process are not performed. Transmittance properties in the comparative example are indicated by a dashed line.

In addition, in the exemplary embodiment, a configuration is adopted in which both the tr correction and the tf correction are performed for R and B, only the tr correction is performed for G, and the black floating process is performed for R, G, and B. However, for B in FIG. 17 to FIG. 20, as a reference example, a case is illustrated in which the tr correction and the black floating process are performed, and the tf correction is not performed. Transmittance properties in the exemplary embodiment and the reference example are indicated by a solid line.

Figure 17:
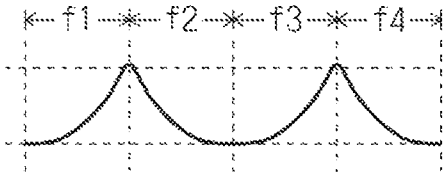
FIG. 17 is a diagram for explaining operation of the image processing circuit.
Figure 17:
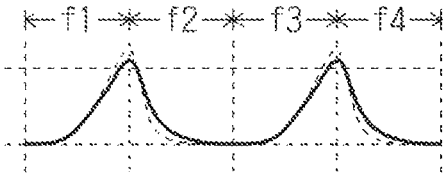
Figure 17:
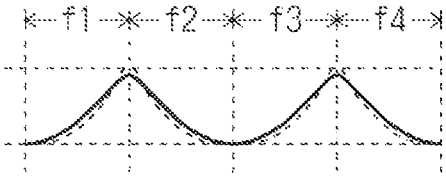

When the pattern A is displayed as illustrated in FIG. 17, according to the comparative example for R, in the fields f1 and f3, an applied voltage to the liquid crystal element 120 is 2.6 V, and is 0.0 V in the fields f2 and f4 due to the tr correction. In the exemplary embodiment, the tr correction and the black floating process are performed, but the exemplary embodiment is the same as the comparative example for the pattern A. Thus, when the pattern A is displayed for R, a difference is not generated between the comparative example and the exemplary embodiment.

According to the comparative example for G, in the fields f1 and f3, the applied voltage to the liquid crystal element 120 is 2.3 V, and is 0.0 V in the fields f2 and f4 due to the tr correction.

In the exemplary embodiment, the black floating process improves transmittance initial rise properties with a less amount of overdrive. Specifically, when black changes to white by the tr correction, the applied voltage to the liquid crystal element 120 is 2.3 V in the comparative example, but in the exemplary embodiment, a voltage before change is replaced with 1.0 V by the black floating process, thus 2.2 V which is less than the comparative example is sufficient.

Therefore, in the exemplary embodiment, the transmittance initial rise properties in the fields f1 and f3 are improved compared to the comparative example, and approach properties of R in the exemplary embodiment. Note that, an actual transmittance is visually recognized as an integrated value of the transmittance properties described above.

According to the comparative example for B, in the fields f1 and f3, the applied voltage to the liquid crystal element 120 is 2.3 V, and is 0.0 V in the fields f2 and f4 due to the tr correction. In the exemplary embodiment, the black floating process improves transmittance initial rise properties with a less amount of overdrive. Specifically, when black changes to white by the tr correction, the applied voltage to the liquid crystal element 120 is 2.3 V in the comparative example, but in the exemplary embodiment, a voltage before change is replaced with 1.0 V by the black floating process, thus 2.2 V which is less than the comparative example is sufficient.

However, since the tf correction is not performed in this reference example, there is room for improving transmittance falling properties. In other words, it is conceivable that by performing the tf correction as in the exemplary embodiment for B, the transmittance falling properties are improved, and approach the properties of R.

Figure 18:
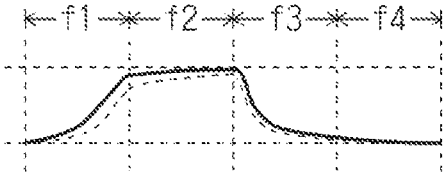
FIG. 18 is a diagram for explaining the operation of the image processing circuit.
Figure 18:
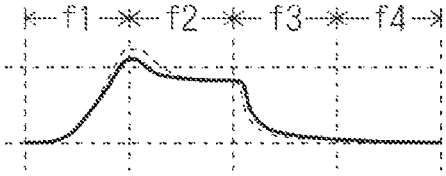
Figure 18:
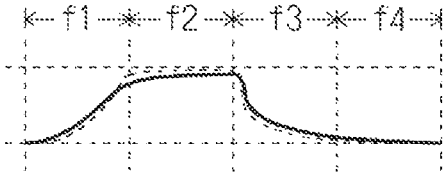

When the pattern B is displayed as illustrated in FIG. 18, according to the comparative example for R, an applied voltage to the liquid crystal element 120 is 2.6 V in the field f1, and is 2.2 V that is a voltage corresponding to white and for which the overdrive is not performed in the field f2, by the tr correction. Also, the applied voltage is 0.0 V in the fields f3 and f4.

In exemplary embodiment, for R, the applied voltage to the liquid crystal element 120 is changed to 1.0 V, by the black floating process in the field f4 with respect to the comparative example. Thus, in the exemplary embodiment, the transmittance initial rise properties are improved when transition is made from the field f4 to the field f1, with respect to the comparative example.

According to the comparative example for G, the applied voltage to the liquid crystal element 120 is 2.3 V in the field f1, and is 2.1 V that is a voltage corresponding to white and for which the overdrive is not performed in the field f2, by the tr correction. Also, the applied voltage is 0.0 V in the fields f3 and f4.

In the exemplary embodiment, for G, since the tf correction is not performed, and the black floating process is performed, a change to 1.0 V is made in the fields f3 and F4 with respect to the comparative example. In the exemplary embodiment, in the field f1, the black floating process improves the transmittance initial rise properties with a less amount of overdrive. Specifically, when black changes to white by the tr correction, the applied voltage to the liquid crystal element 120 is 2.3 V in the comparative example, but in the exemplary embodiment, a voltage before change is replaced with 1.0 V by the black floating process, thus 2.2 V which is less than the comparative example is sufficient. Thus, in the exemplary embodiment, the transmittance initial rise properties are improved when transition is made from the field f4 to the field f1, with respect to the comparative example, and approach the properties of R in the exemplary embodiment.

According to the comparative example for B, the applied voltage to the liquid crystal element 120 is 2.2 V in the field f1, and is 2.0 V that is a voltage corresponding to white and for which the overdrive is not performed in the field f2, by the tr correction. Also, the applied voltage is 0.0 V in the fields f3 and f4. In the reference example, by performing the black floating process, a change to 1.0 V is made in the fields f3 and f4. In the exemplary embodiment, in the field f1, the black floating process improves the transmittance initial rise properties with a less amount of overdrive.

However, since the tf correction is not performed in this reference example, there is room for improving transmittance falling properties. In other words, when the tf correction is performed as in the exemplary embodiment, specifically, when the applied voltage to the liquid crystal element 120 is 0.0 V in the field f3, it is conceivable that the transmittance falling properties are improved, and approach the properties of R.

Figure 19:
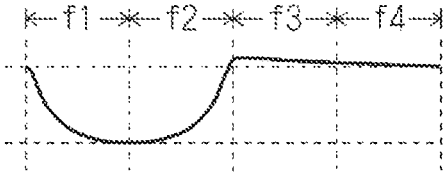
FIG. 19 is a diagram for explaining the operation of the image processing circuit.
Figure 19:
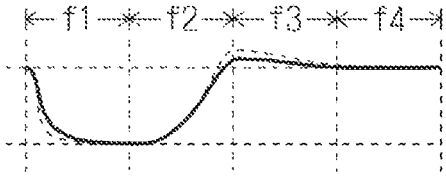
Figure 19:
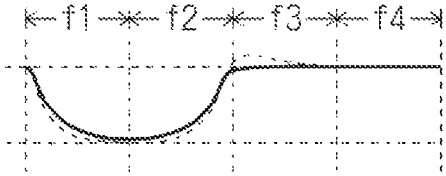

When the pattern C is displayed as illustrated in FIG. 19, according to the comparative example for R, the applied voltage to the liquid crystal element 120 is 0.0 V in the field f1, and is 2.6 V by the tr correction in the field f2. Also, the applied voltage is 2.2 V corresponding to white in the fields f3 and f4. In the exemplary embodiment, the tr correction and the black floating process are performed, but the exemplary embodiment is the same as the comparative example for the pattern A. Thus, when the pattern A is displayed for R, a difference is not generated between the comparative example and the exemplary embodiment.

According to the comparative example for G, the applied voltage to the liquid crystal element 120 is 0.0 V in the field f1, and is 2.3 V in the field f2, by the tr correction. Also, the applied voltage is 2.1 V corresponding to white in the fields f3 and f4.

In the exemplary embodiment, for G, since the tf correction is not performed, and the black floating process is performed, a change to 1.0 V is made in the field f1 with respect to the comparative example. Further, the black floating process improves the transmittance initial rise properties with a less amount of overdrive. In particular, when a change to white is made in the field f2, in the exemplary embodiment, 2.2 V which is lower compared to the comparative example is sufficient due to the black floating process. Therefore, in the exemplary embodiment, the transmittance initial rise properties in the field f2 are improved compared to the comparative example, and approach the properties of R in the exemplary embodiment.

According to the comparative example for B, the applied voltage to the liquid crystal element 120 is 0.0 V in the field f1, and is 2.3 V in the field f2, by the tr correction. Also, the applied voltage is 2.0 V corresponding to white in the fields f3 and f4.

In the exemplary embodiment, due to the black floating process, the applied voltage to the liquid crystal element 120 is 1.0 V in the field f1, and is 2.2 V in the field f2, by the tr correction. Also, the applied voltage is 2.0 V corresponding to white in the fields f3 and f4.

However, since the tf correction is not performed in this reference example, there is room for improving transmittance falling properties. Specifically, when the applied voltage to the liquid crystal element 120 is 0.0 V in the field f1, it is conceivable that the transmittance falling properties are improved, and approach the properties of R.

Figure 20:
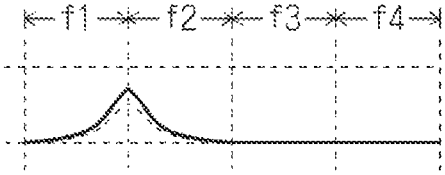
FIG. 20 is a diagram for explaining the operation of the image processing circuit.
Figure 20:
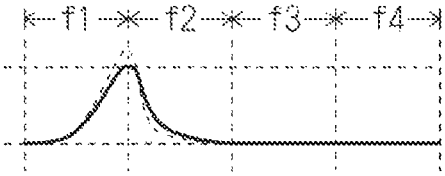
Figure 20:
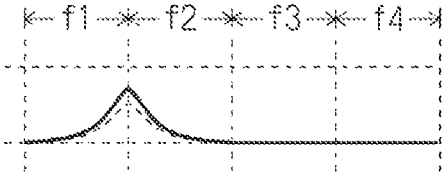

When the pattern D is displayed as illustrated in FIG. 20, in the comparative example for R, the applied voltage of the liquid crystal element 120 is 2.6 V in the field f1, and is 0.0 V in the field f2, and is 0.0 V corresponding to black in the fields f3 and f4, by the tr correction.

In the exemplary embodiment for R, the applied voltage to the liquid crystal element 120 is 2.3 V in the field f1 by the tr correction, and is 0.0 V by the tf correction in the field f2, and is 1.0 V by the black floating process in the fields f3 and f4. The transmittance initial rise properties in field f1 are improved by the black floating process in the field f4.

When the pattern D is displayed, in the comparative example for G, the applied voltage to the liquid crystal element 120 is 2.3 V in the field f1, and is 0.0 V corresponding to black in the fields f2, f3, and f4, by the tr correction.

In the exemplary embodiment for G, the applied voltage to the liquid crystal element 120 is 2.2 V in the field f1 by the tr correction, and is 1.0 V by the black floating process without performing the tf correction in the field f2, and is similarly 1.0 V in the fields f3 and f4. Due to the black floating process in the field f4, the transmittance initial rise properties are improved in the field f1, with an amount of overdrive less than that in the comparative example.

In the comparative example for B, the applied voltage to the liquid crystal element 120 is 2.3 V in the field f1, and is 0.0 V corresponding to black in the fields f2, f3, and f4, by the tr correction.

In the reference example for B, the applied voltage to the liquid crystal element 120 is 2.2 V in the field f1 by the tr correction, and is 1.0 V by the black floating process, similarly to G, in the fields f2, f3, and f4.

However, since the tf correction is not performed in this reference example, there is room for improving the transmittance falling properties in the field f2. In other words, when the tf correction is performed as in the exemplary embodiment for B, specifically, when the applied voltage to the liquid crystal element 120 is 0.0 V in the field f2, the transmittance falling properties are improved.

In this manner, when the patterns A, B, C, and D are displayed, by performing the tr correction and the tf correction not only for R, but for B, performing only the tr correction for G, and performing the black floating process for R, G, and B, respective transmittances of R, G, and B are easily to be made even, so it is easy to suppress coloring.

In the exemplary embodiment, the following variations or applications are possible.

In the exemplary embodiment, the liquid crystal panels 100R, 100G, and 100B are of a transparent type, but may be a reflective type. When the liquid crystal panels 100R, 100G, and 100B are of a reflective type, a transmittance in optical responsiveness only needs to be replaced with and read as a reflectance.

The liquid crystal element 120 is in the normally black mode, but may be in a normally white mode. When the liquid crystal element 120 is in the normally white mode, it is sufficient to adopt a configuration in which a data signal is output such that the applied voltage of the liquid crystal element 120 is decreased in accordance with an increase in a gray scale level.

Even in the case of the normally white mode, similarly to the normally black mode, in the black floating process, when a voltage applied to the liquid crystal element 120 is less than a threshold value corresponding to a gray scale level specified by image data, the applied voltage to the liquid crystal element 120 is increased to be higher than a voltage corresponding to the gray scale level. However, in the case of the normally white mode, the black floating process is performed when the gray scale level exceeds the threshold value.

The coloring occurs when the liquid crystal panels 100R, 100G, and 100B are different in optical responsiveness, without shifting a projection position by the shifting device 230. Thus, the present disclosure is also effective in configurations without the shifting device 230. Specifically, when the optical responsiveness of the liquid crystal panel 100G is better than the optical responsiveness of the liquid crystal panels 100R and 100B, even in a configuration where the shifting device 230 is not included, and a projection position is not shifted, by performing the tr correction for R and B, performing only the tr correction for G, and performing the black floating process for R, G, and B, the respective transmittances of R, G, and B are easily to be made even, and thus the coloring can be suppressed.

Conversely, in a configuration in which a frame is divided into multiple fields by the shifting device 230, and a projection position is shifted per field, a period of the field is shortened, and thus a difference in optical responsiveness is likely to appear as coloring. Therefore, a configuration may be adopted in which, when a synthesized image is produced by a plurality of the liquid crystal panels 100, and there are differences in optical responsiveness in the plurality of liquid crystal panels 100, the tr correction and the tf correction are performed for the liquid crystal panel 100 for a color having low optical responsiveness, only the tr correction is performed for the liquid crystal panel 100 for a color having high optical responsiveness, and the black floating process is performed for the liquid crystal panel 100 for each color.

As described above, the optical responsiveness of the liquid crystal element 120 in the liquid crystal panel 100 changes depending on temperature, and the optical responsiveness of the liquid crystal element 120 becomes better as temperature increases. When the optical responsiveness is good, a small amount of overdrive is sufficient (as viewed as an absolute value). In the liquid crystal projector 1, depending on a usage situation, in particular, temperature increases depending on an elapsed time from power source on, and the optical responsiveness is improved in some cases. In the exemplary embodiment, the amount of overdrive is adjustable by the multiplier 233 in FIG. 15. Specifically, according to a configuration in which, depending on the elapsed time from power source on, the coefficients K_R, K_G, and K_B are gradually decreased from "1", it is possible to adjust the amount of overdrive depending on temperature.

The coefficients K_R, K_G, and K_B may be the same value, or independent value may be supplied for each color.

Note that in the exemplary embodiment, G is an example of a first color, R or B is an example of a second color, and the liquid crystal panel 100G is an example of a first liquid crystal panel, and the liquid crystal panel 100R or the liquid crystal panel 100B is an example of a second liquid crystal panel. Additionally, the liquid crystal element 120 of the pixel circuit 110 in the liquid crystal panel 100G is an example of a first liquid crystal element, and the liquid crystal element 120 of the pixel circuit 110 in the liquid crystal panel 100R or 100B is an example of a second liquid crystal element. The data signal Vid_G is an example of first data signal, and the data signal Vid_R or Vid_B is an example of second data signal. The tr correction is an example of a first correction, and the tf correction is an example of a second correction. The LUT 232R and LUT 232B are examples of a first LUT, and the LUT 232G is an example of a second LUT.

When a voltage applied to the liquid crystal element 120 for G is less than a threshold value, and the black floating process is performed, the threshold value is an example of a first threshold value. Further, when a voltage applied to the liquid crystal element 120 for R or B is less than a threshold value, and the black floating process is performed, the threshold value is an example of a second threshold value. The image data pixel A1 is an example of a first pixel, and the image data pixel A2 is an example of a second pixel.

The dichroic prism 2112 is an example of a synthesis unit.

Of projection positions by the shifting device 230, a projection position in the field f1 is an example of a first position, and a projection position in the field f2 is an example of a second position.

What is claimed is:

1. A liquid crystal projector, comprising:

a display control circuit configured to process image data of a first color, of image data specifying a gray scale level of a pixel and output the image data of the first color as a first data signal, and to process image data of a second color different from the first color, of the image data and output the image data of the second color as a second data signal;

a first liquid crystal panel including a first liquid crystal element to which a voltage is applied in accordance with the first data signal, the first liquid crystal element emitting incident light of the first color as first emission light at a ratio corresponding to an applied voltage;

a second liquid crystal panel including a second liquid crystal element to which a voltage is applied in accordance with the second data signal, the second liquid crystal element emitting incident light of the second color as second emission light at a ratio corresponding to an applied voltage; and a prism configured to synthesize the first emission light and the second emission light, and emit the synthesized emission light as synthesized light, wherein the display control circuit includes a gray scale level converter for, when a voltage applied to the first liquid crystal element corresponding to a gray scale level specified by the image data of the first color is less than a first threshold value, correcting the first data signal, to increase a voltage applied to the first liquid crystal element to be higher than a voltage corresponding to the gray scale level, and when a voltage applied to the second liquid crystal element corresponding to a gray scale level specified by the image data of the second color is less than a second threshold value, correcting the second data signal, to increase a voltage applied to the second liquid crystal element to be higher than a voltage corresponding to the gray scale level, does not perform overdrive processing for the first liquid crystal element when a voltage applied to the first liquid crystal element decreases due to a change in a gray scale level specified by the image data of the first color, and performs overdrive processing for the second liquid crystal element when a voltage applied to the second liquid crystal element decreases due to a change in a gray scale level specified by the image data of the second color;

the overdrive processing includes a first correction for increasing an applied voltage to the first liquid crystal element or the second liquid crystal element, and a second correction for decreasing an applied voltage to the second liquid crystal element; and the display control circuit performs the first correction for the first liquid crystal element, when a voltage applied to the first liquid element is increased due to a change in a gray scale level specified by the image data of the first color, performs the first correction for the second liquid crystal element, when a voltage applied to the second liquid element is increased due to a change in a gray scale level specified by the image data of the second color, and performs the second correction for the second liquid crystal element, when a voltage applied to the second liquid crystal element is decreased.

2. The liquid crystal projector according to claim 1, wherein the display control circuit includes a first LUT storing an amount of overdrive when a voltage applied to the first liquid crystal element is increased due to a change in a gray scale level specified by the image data of the first color, and a second LUT storing an amount of overdrive when a voltage applied to the second liquid crystal element is increased and when a voltage applied to the second liquid crystal element is decreased, due to a change in a gray scale level specified by the image data of the second color, and performs overdrive processing based on the first LUT and the second LUT.

3. The liquid crystal projector according to claim 1, wherein optical responsiveness of the second liquid crystal element is lower than optical responsiveness of the first liquid crystal element.

4. The liquid crystal projector according to claim 1, wherein an amount of overdrive in the first color is less than an amount of overdrive in the second color.

5. The liquid crystal projector according to claim 1, wherein an amount of overdrive in the first color and an amount of overdrive in the second color are changeable.

* * * * *